US008181479B2

(12) United States Patent
Tsukamoto et al.

(10) Patent No.: US 8,181,479 B2
(45) Date of Patent: May 22, 2012

(54) INLET GUIDE VANE, TURBO COMPRESSOR, AND REFRIGERATOR

(75) Inventors: Minoru Tsukamoto, Yokohama (JP); Noriyasu Sugitani, Yokohama (JP)

(73) Assignee: IHI Corporation (JP)

( * ) Notice: Subject to any disclaimer, the term of this patent is extended or adjusted under 35 U.S.C. 154(b) by 644 days.

(21) Appl. No.: 12/366,891

(22) Filed: Feb. 6, 2009

(65) Prior Publication Data

US 2009/0193844 A1 Aug. 6, 2009

(30) Foreign Application Priority Data

Feb. 6, 2008 (JP) ..... P2008-027070

(51) Int. Cl.
*F25B 1/00* (2006.01)
*F01B 25/02* (2006.01)
*F01D 1/02* (2006.01)

(52) U.S. Cl. ..... 62/498; 415/159; 415/163; 415/193

(58) Field of Classification Search ..... 62/498; 415/148, 159, 161, 163, 191, 193
See application file for complete search history.

(56) References Cited

U.S. PATENT DOCUMENTS

| | | | | |
|---|---|---|---|---|
| 5,807,071 | A * | 9/1998 | Brasz et al. | 415/150 |
| 2007/0092372 | A1 | 4/2007 | Carroll et al. | 415/191 |
| 2007/0147984 | A1 | 6/2007 | Takahashi et al. | 415/100 |
| 2007/0154302 | A1 * | 7/2007 | Sconfietti | 415/191 |

FOREIGN PATENT DOCUMENTS

| | | |
|---|---|---|
| JP | 2007-120494 | 5/2007 |
| JP | 2007-177695 | 7/2007 |

* cited by examiner

*Primary Examiner* — Chen Wen Jiang
(74) *Attorney, Agent, or Firm* — Ostrolenk Faber LLP

(57) ABSTRACT

An inlet guide vane is installed at a suction port into which a fluid is sucked by the rotation of an impeller so as to be rotatable about an axis, and is comprised of a rod-like shaft supported by an inner peripheral surface of the suction port so as to be rotatable about the axis, and a plate-like vane body connected to the shaft and provided so as to protrude from the inner peripheral surface of the suction port. The vane body includes a tapered portion formed such that both side surfaces approach each other toward an outer edge of the vane body in its width direction and an outer edge thereof at a tip in the direction of the axis, and a parallel portion arranged on the axis and formed such that both the side surfaces are parallel to each other along the direction of the axis.

6 Claims, 6 Drawing Sheets

INLET GUIDE VANE, TURBO COMPRESSOR, AND REFRIGERATOR

BACKGROUND OF THE INVENTION

1. Field of the Invention

The present invention relates to an inlet guide vane which is installed at a suction port into which a fluid is sucked by the rotation of an impeller and adjusts the suction volume and flow direction of the fluid, a turbo compressor, and a refrigerator.

Priority is claimed on Japanese Patent Application No. 2008-027070, filed Feb. 6, 2008, the content of which is incorporated herein by reference.

2. Description of the Related Art

As refrigerators which cool or freeze objects to be cooled, such as water, a turbo refrigerator or the like including a turbo compressor which compresses and discharges a refrigerant (fluid) by an impeller is known. In a compressor, when a compression ratio increases, the discharge temperature of the compressor becomes high and the volumetric efficiency thereof degrades. Therefore, the compressor is adapted to perform compression of refrigerant in a plurality of stages. For example, a turbo compressor which includes two compression stages provided with an impeller and a diffuser and compresses a refrigerant sequentially in these compression stages is disclosed in Patent Document 1 (Japanese Patent Unexamined Publication No. 2007-177695).

Such a turbo compressor is provided with a suction port for allowing the refrigerant to be sucked thereinto by the rotation of the impeller of the first compression stage, and a plurality of inlet guide vanes for adjusting the suction volume and flow direction of the refrigerant are arranged in parallel in a peripheral direction in this suction port.

Each inlet guide vane includes, for example, a rod-like shaft and a plate-like vane body connected to the shaft where directions of their axes are arranged on the same line, and is molded as a cast product. In this inlet guide vane, the shaft is connected to and supported by a drive mechanism, and the vane body is installed so as to protrude radially inward from an inner peripheral surface of the suction port toward a central portion thereof. Also, the suction volume and flow direction of the refrigerant sucked in are adjusted according to the angle of attack (rotating angle) of each inlet guide vane by rotating each inlet guide vane around the axis by the drive mechanism.

Additionally, as this type of inlet guide vane, there is one in which the vane body is formed in the shape of a flat plate or one in which a side surface (side surface which faces an impeller) on the side which becomes positive pressure and a side surface on the side which becomes negative pressure are formed in the shape of an aerofoil as curved surfaces (for example, refer to Patent Document 2 (Japanese Patent Unexamined Publication No. 2007-120494)).

However, in the inlet guide vane in which the vane body is formed in the shape of a flat plate, while the manufacture (molding) of the inlet guide vane is easy, the thickness of the vane body is constant from the inner peripheral surface of the suction port toward the central portion with a large flow velocity. Therefore, the flow of the refrigerant is disturbed, and the pressure loss becomes large. For this reason, there is a problem in that performance deterioration of the turbo compressor is caused.

Meanwhile, in the inlet guide vane in which the vane body is formed in the shape of an aerofoil, the side surface on the side of positive pressure and the side surface on the side of negative pressure are formed by curved surfaces. Therefore, the suction volume and the flow direction of a refrigerant can be adjusted without disturbing the flow of the refrigerant, and the pressure loss can be made small.

However, since this type of inlet guide vane is molded as a cast product, it is difficult to form the side surface on the side of positive pressure and the side surface on the side of negative pressure as curved surfaces with precision by casting. Additionally, it is necessary to machine the shaft after casting, and at this time, reference setting is performed with the vane body held. However, if both the side surfaces of the vane body are formed by curved surfaces, the reference setting becomes difficult. For this reason, there is a problem in that it is difficult to manufacture the inlet guide vane with high precision.

SUMMARY OF THE INVENTION

The invention provides an inlet guide vane capable of easily machining a shaft and capable of reliably reducing a pressure loss, a turbo compressor including the inlet guide vane, and a refrigerator including the turbo compressor, in view of the above situations.

The inlet guide vane of the present invention is an inlet guide vane which is installed at a suction port into which a fluid is sucked by the rotation of an impeller so as to be rotatable about an axis and adjusts the suction volume and flow direction of the fluid to the suction port. The inlet guide vane is comprised of a rod-like shaft supported by an inner peripheral surface of the suction port so as to be rotatably supported about the axis, and a plate-like vane body connected to the shaft and provided so as to protrude from the inner peripheral surface of the suction port toward a central portion thereof. The vane body has a side surface on the side which becomes positive pressure and a side surface on the side which becomes negative pressure, at the time of adjustment of the suction volume and flow direction of the fluid. The vane body includes a tapered portion formed such that the two side surfaces approach each other toward an outer edge of the vane body in its width direction and an outer edge thereof at a tip in the direction of the axis, and a parallel portion arranged on the axis and formed such that the side surface on the side which becomes positive pressure and the side surface on the side which becomes negative pressure are parallel to each other along the direction of the axis.

In this invention, the tapered portion of the vane body is formed such that the side surface (side surface on the side of positive pressure) on the side which becomes positive pressure and the side surface on the side (side surface on the side of negative pressure) which becomes negative pressure approach each other toward an outer edge in a width direction and an outer edge thereof at a tip in the direction of the axis, i.e., such that the thickness of the vane body becomes small toward an outer edge in a flow direction of the fluid and an outer edge disposed at a central portion of the suction port with a large flow velocity. Therefore, the suction volume and flow direction of a fluid can be adjusted without disturbing the flow of the fluid, and the pressure loss can be made reliably small.

Additionally, since the parallel portion in which the side surface on the side of positive pressure and the side surface on the side of negative pressure are parallel to each other in the direction of the axis is provided on the axis, reference setting can be easily performed by holding the parallel portion at the time of machining of the shaft after casting. Hence, it is possible to reduce the manufacturing cost of the inlet guide vane.

Additionally, in the inlet guide vane of the present invention, it is desirable that the parallel portion be provided at a rear end, in the direction of the axis, of the vane body which is connected to the shaft.

In this invention, the thickness at the tip of the vane body can be made reliably smaller by providing the parallel portion at the rear end in the direction of the axis, and thereby largely providing the tapered portion at the tip arranged at the central portion of the suction port with a large flow velocity. Hence, it is possible to make the pressure loss reliably small.

Moreover, in the inlet guide vane of the present invention, it is preferable that the length of the parallel portion in the direction of the axis be equal to or more than ¼ and equal to or less than ½ of the length of the vane body in the direction of the axis.

In this case, since the parallel portion is formed with a length that is equal to or more than ¼ the length of the vane body, the reference setting can be performed by reliably holding the parallel portion at the time of machining of the shaft. Additionally, the parallel portion is formed with a length that is equal to or less than ½ of the length of the vane body. Hence, with the tapered portion provided at the tip arranged at the central portion of the suction port with a large flow velocity, the suction volume and flow direction of a fluid can be adjusted without disturbing the flow of the fluid, and the pressure loss can be made reliably small.

The turbo compressor of the present invention is a turbo compressor for sucking in a fluid from a suction port, compressing the fluid, and supplying the fluid to a condenser. The turbo compressor includes a plurality of compression devices arranged in series with the flow of the fluid sucked from the suction port. Each compression device includes an impeller and a diffuser, and the fluid is allowed to be compressed sequentially in a plurality of the compression devices. Any inlet guide vane of the above inlet guide vanes is installed at the suction port.

In this turbo compressor, by providing the inlet guide vane, it is possible to reduce the consumption power of the turbo compressor and to improve the performance thereof.

The refrigerator of the present invention is a refrigerator including a condenser which cools and liquefies a compressed refrigerant, an evaporator which evaporates the liquefied refrigerant and deprives vaporization heat from an object to be cooled, thereby cooling the object to be cooled, and a compressor which compresses the refrigerant evaporated in the evaporator and supplies the refrigerant to the condenser. The above turbo compressor is used as the compressor.

In this refrigerator, by providing the turbo compressor, it is possible to reduce the consumption power of the refrigerator and to improve the performance thereof.

According to the inlet guide vane of the present invention, by providing the tapered portion, the suction volume and the flow direction of a fluid can be adjusted without disturbing the flow of the fluid, and the pressure loss can be made reliably small. Additionally, by providing the parallel portion, reference setting can be easily performed at the time of machining of the shaft, and the shaft can be machined easily. As a result, the inlet guide vane can be manufactured with high precision, and the manufacturing cost can be reduced.

Additionally, according to the turbo compressor and refrigerator of the present invention, by providing the inlet guide vane according to the present invention, the consumption power can be reduced, and the performance can be improved. In the turbo refrigerator, the COP (coefficient of performance) can be raised.

DETAILED DESCRIPTION OF THE PRESENT INVENTION

Hereinafter, inlet guide vanes, a turbo compressor, and a refrigerator according to the present invention will be described with reference to FIGS. 1 to 8. This embodiment relates to a refrigerator which cools or freezes objects to be cooled, such as water, and to a refrigerator including a turbo compressor which is adapted to compress a refrigerant in a plurality of stages.

Figure 1:
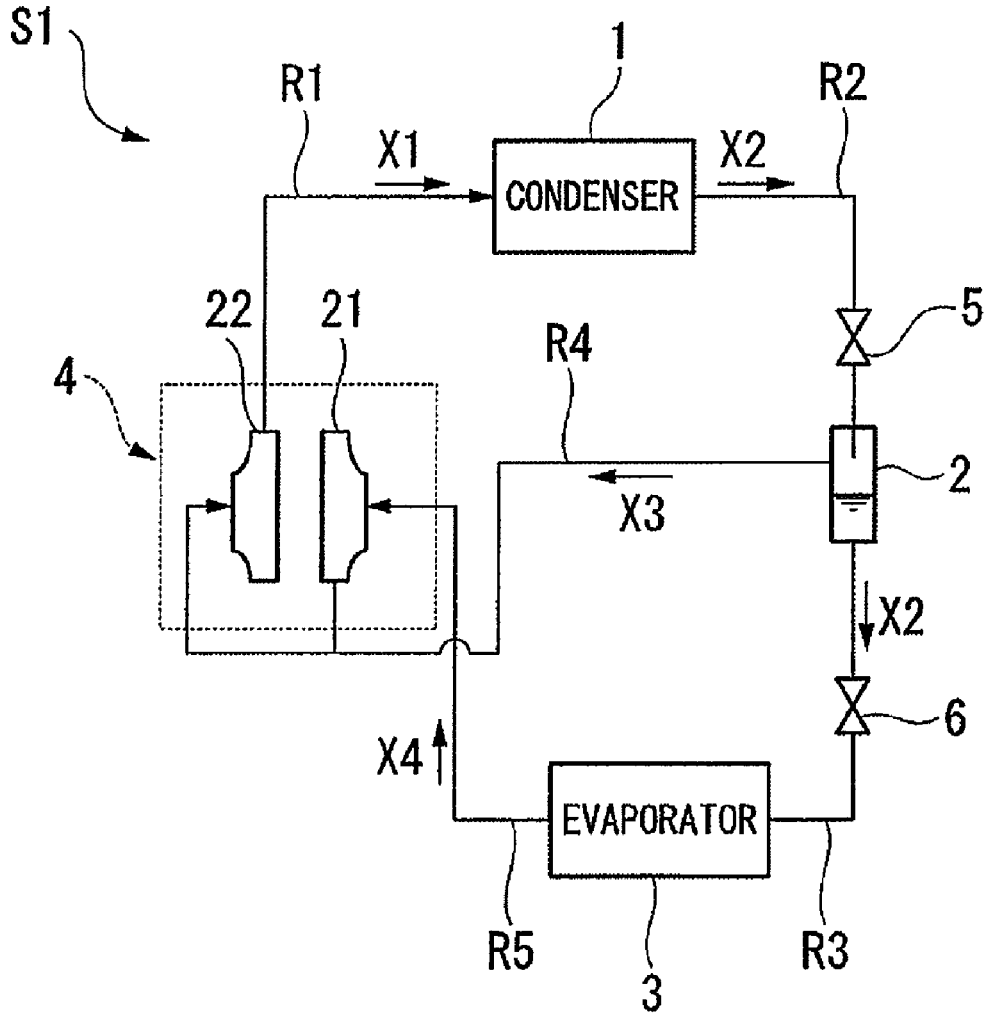
FIG. 1 is a block diagram showing a schematic configuration of a turbo refrigerator according to one embodiment of the present invention.

FIG. 1 is a block diagram showing a schematic configuration of a turbo refrigerator S1 (refrigerator) in this embodiment.

The turbo refrigerator S1 in this embodiment is installed in buildings or factories in order to generate, for example, cooling water for air conditioning, and as shown in FIG. 1, includes a condenser 1, an economizer 2, an evaporator 3, and a turbo compressor 4.

The condenser 1 is supplied with a compressed refrigerant gas X1 that is a refrigerant (fluid) compressed in a gaseous state, and cools and liquefies the compressed refrigerant gas X1 to generate a refrigerant fluid X2. The condenser 1, as shown in FIG. 1, is connected to the turbo compressor 4 via a flow path R1 through which the compressed refrigerant gas X1 flows, and is connected to the economizer 2 via a flow path R2 through which the refrigerant fluid X2 flows. In addition, an expansion valve 5 for decompressing the refrigerant fluid X2 is installed in the flow path R2.

The economizer 2 temporarily stores the refrigerant fluid X2 decompressed in the expansion valve 5. The economizer 2 is connected to the evaporator 3 via a flow path R3 through which the refrigerant fluid X2 flows, and is connected to the turbo compressor 4 via a flow path R4 through which a gaseous refrigerant X3 generated in the economizer 2 flows. In addition, an expansion valve 6 for further decompressing the refrigerant fluid X2 is installed in the flow path R3. Additionally, the flow path R4 is connected to the turbo compressor 4 so as to supply the gaseous refrigerant X3 to a second compression stage 22 (which will be described later) included in the turbo compressor 4.

The evaporator 3 evaporates the refrigerant fluid X2 to remove vaporization heat from an object to be cooled, such as water, thereby cooling an object to be cooled. The evaporator 3 is connected to the turbo compressor 4 via a flow path R5 through which a refrigerant gas X4 generated as the refrigerant fluid X2 flows and is evaporated. In addition, the flow path R5 is connected to a first compression stage 21 included in the turbo compressor 4.

The turbo compressor 4 compresses the refrigerant gas X4 to generate the compressed refrigerant gas X1. The turbo compressor 4 is connected to the condenser 1 via the flow path R1 through which the compressed refrigerant gas X1 flows as described above, and is connected to the evaporator 3 via the flow path R5 through which the refrigerant gas X4 flows.

In the turbo refrigerator S1 configured in this way, the compressed refrigerant gas X1 supplied to the condenser 1 via the flow path R1 is cooled and liquefied into the refrigerant fluid X2 by the condenser 1.

When the refrigerant fluid X2 is supplied to the economizer 2 via the flow path R2, the refrigerant fluid is decompressed by the expansion valve 5. In this decompressed state, the refrigerant fluid is temporarily stored in the economizer 2. Thereafter, when the refrigerant fluid is supplied to the evaporator 3 via the flow path R3, the refrigerant fluid is further decompressed by the expansion valve 6, and is supplied to the evaporator 3 in the decompressed state.

The refrigerant fluid X2 supplied to the evaporator 3 is evaporated into the refrigerant gas X4 by the evaporator 3, and supplied to the turbo compressor 4 via the flow path R5.

The refrigerant gas X4 supplied to the turbo compressor 4 is compressed into the compressed refrigerant gas X1 by the turbo compressor 4, and is supplied again to the condenser 1 via the flow path R1.

The gaseous refrigerant X3 generated when the refrigerant fluid X2 is stored in the economizer 2 is supplied to the turbo compressor 4 via the flow path R4, is compressed along with the refrigerant gas X4, and is supplied to the condenser 1 via the flow path R1 as the compressed refrigerant gas X1.

In such a turbo refrigerator S1, when the refrigerant fluid X2 is evaporated in the evaporator 3, vaporization heat is removed from an object to be cooled, thereby cooling or refrigerating the object to be cooled.

Figure 2:
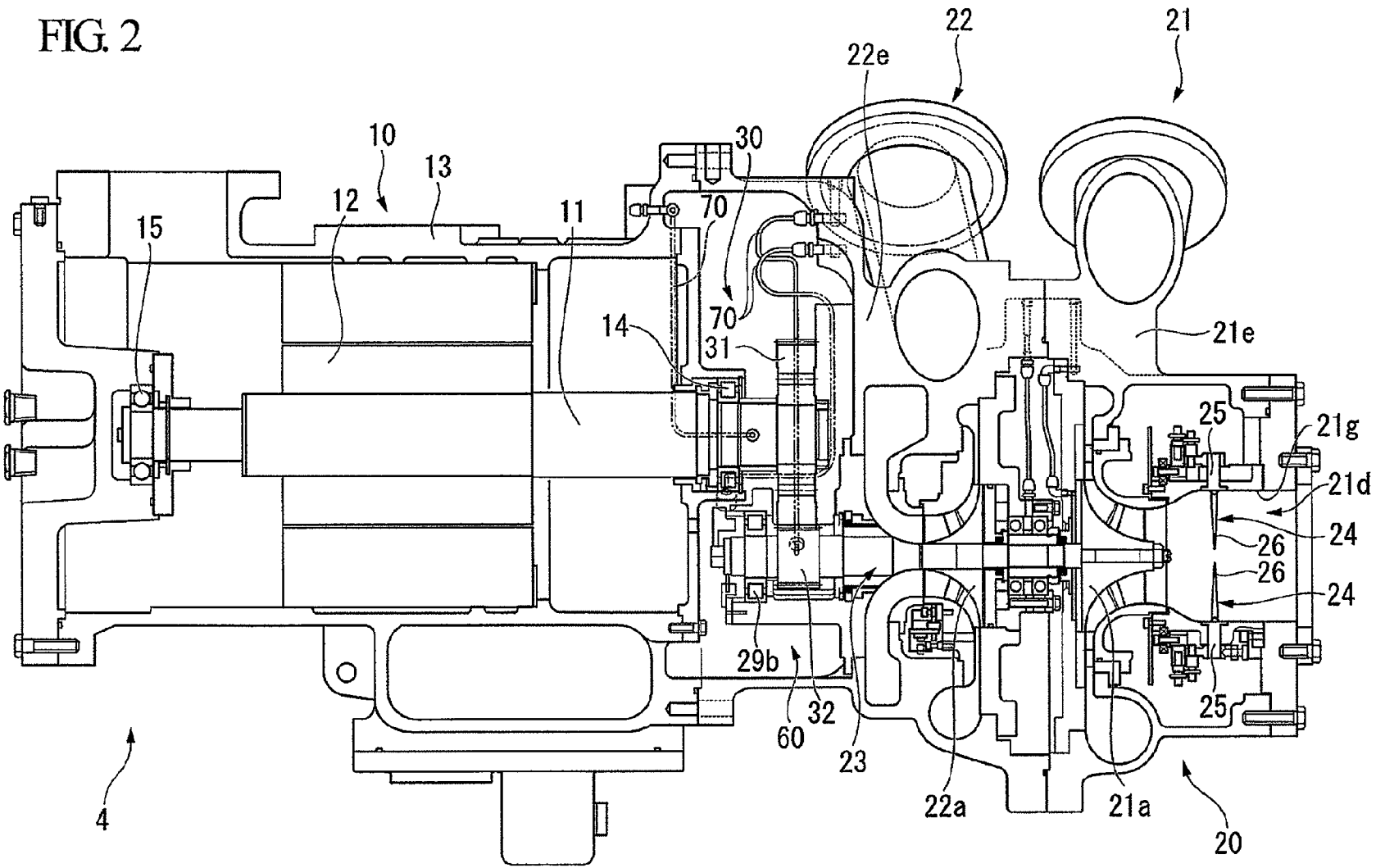
FIG. 2 is a horizontal sectional view of a turbo compressor included in the turbo refrigerator according to one embodiment of the present invention.
Figure 3:
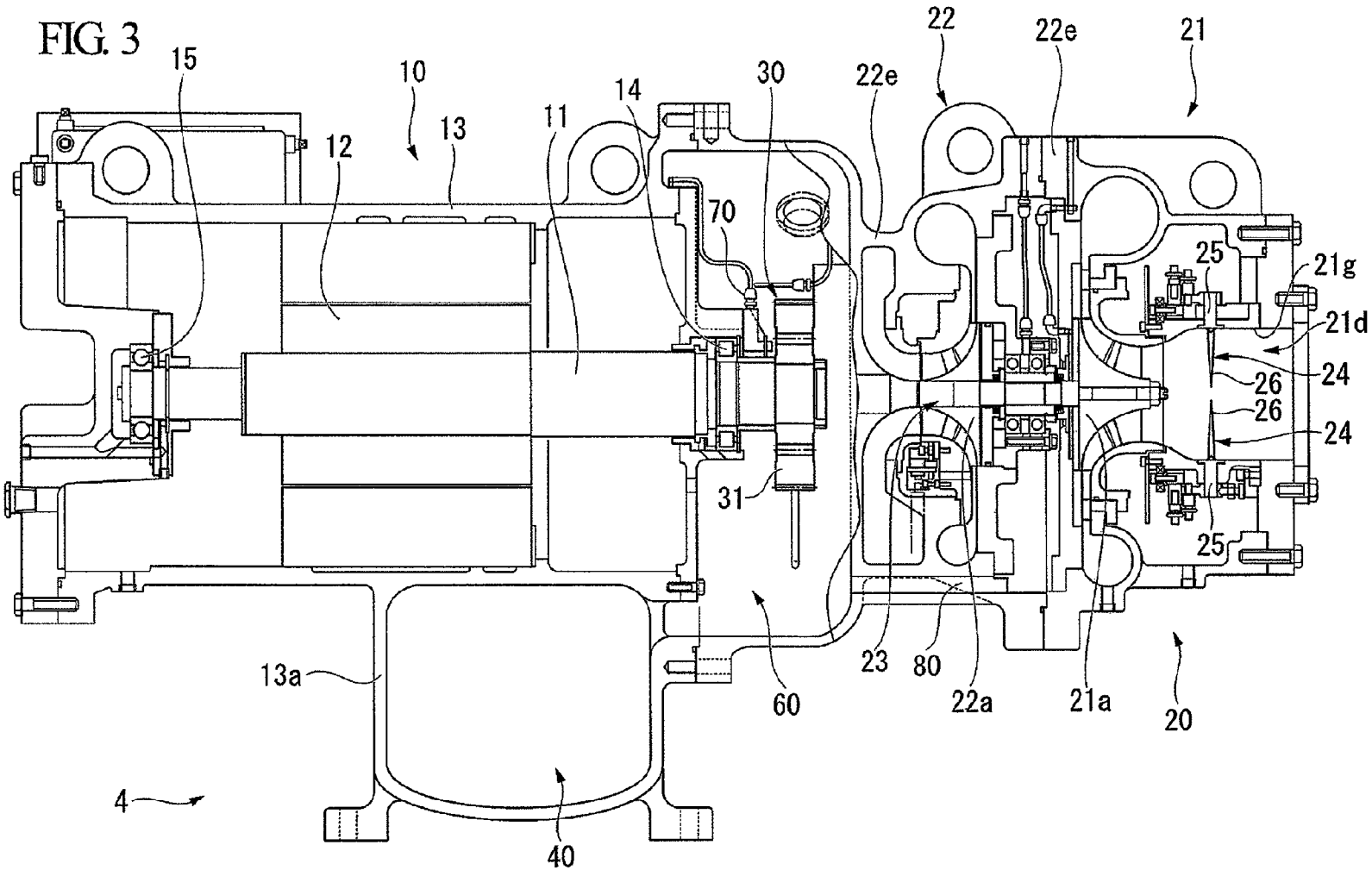
FIG. 3 is a vertical sectional view of a turbo compressor included in the turbo refrigerator according to one embodiment of the present invention.
Figure 4:
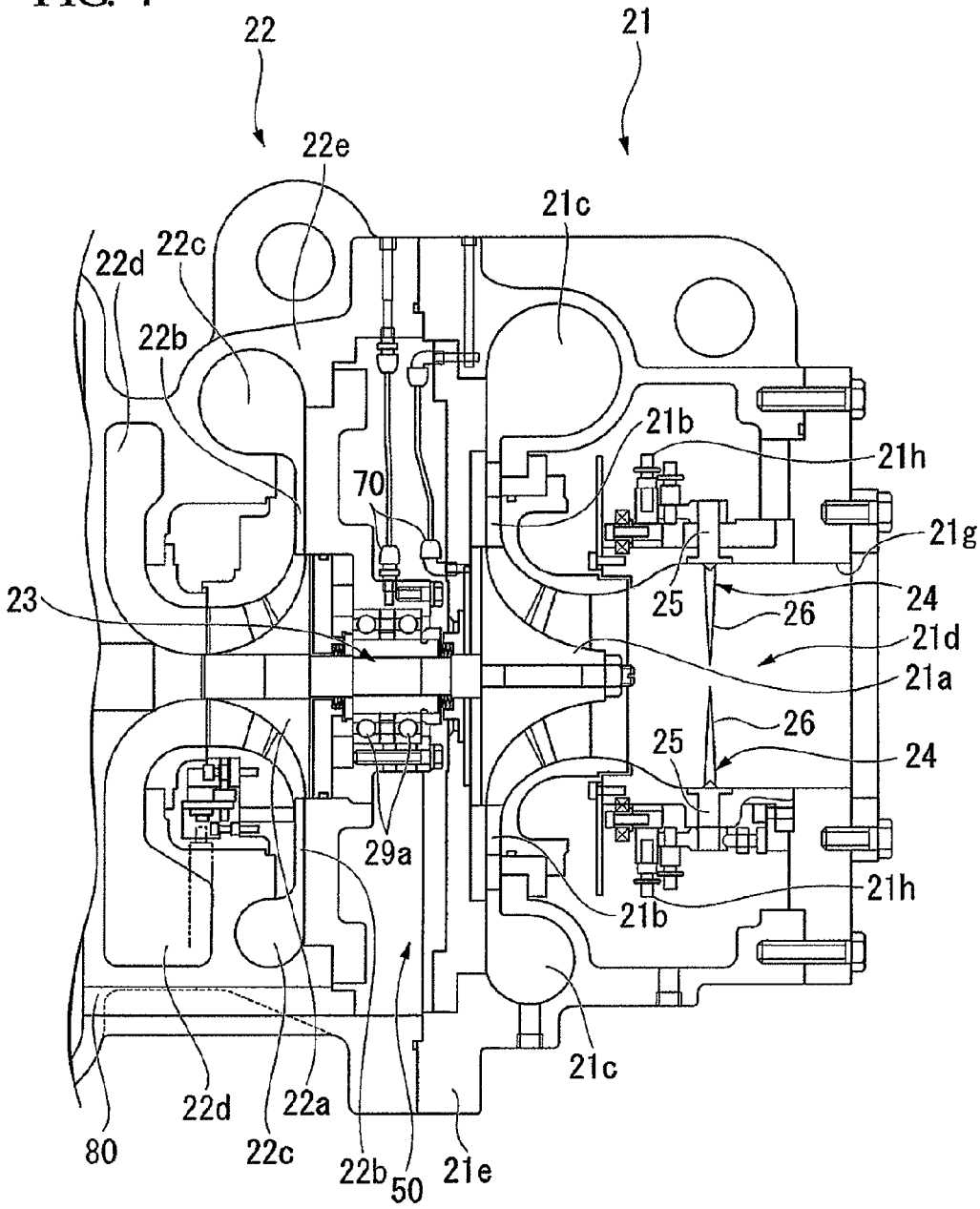
FIG. 4 is an enlarged view of essential parts of FIG. 3.

Subsequently, the turbo compressor 4 will be described in more detail. FIG. 2 is a horizontal sectional view of the turbo compressor 4. FIG. 3 is a vertical sectional view of the turbo compressor 4. FIG. 4 is an enlarged vertical sectional view of a compressor unit 20 included in the turbo compressor 4.

As shown in these drawings, the turbo compressor 4 in this embodiment includes a motor unit 10, a compressor unit 20, and a gear unit 30.

The motor unit 10 includes a motor 12 which has an output shaft 11 and which serves as a driving source for driving the compressor unit 20, and a motor housing 13 which surrounds the motor 12 and supports the motor 12. The output shaft 11 of the motor 12 is rotatably supported by a first bearing 14 and a second bearing 15 which are fixed to the motor housing 13. The motor housing 13 includes a leg portion 13*a* which supports the turbo compressor 4. The inside of the leg portion 13*a* is made hollow, and is used as an oil tank 40 where lubricant supplied to sliding parts of the turbo compressor 4 is stored and recovered.

The compression unit 20 includes the first compression stage 21 (compression device) where the refrigerant gas X4 (refer to FIG. 1) is sucked and compressed, and the second compression stage 22 (compression device) where the refrigerant gas X4 compressed in the first compression stage 21 is further compressed and is discharged as compressed refrigerant gas X1 (refer to FIG. 1).

The first compression stage 21 includes a first impeller (impeller) 21*a* which gives velocity energy to the refrigerant gas X4 to be supplied from a thrust direction, thereby discharging the refrigerant gas in a radial direction, a first diffuser 21*b* which converts the velocity energy given to the refrigerant gas X4 by the first impeller 21*a* into pressure energy, thereby compressing the refrigerant gas X4, a first scroll chamber 21*c* which guides the refrigerant gas X4 compressed by the first diffuser 21*b* to the outside of the first compression stage 21, and a suction port 21*d* which allows the refrigerant gas X4 to be sucked therethrough supplied to the first impeller 21*a*.

The first diffuser 21*b*, the first scroll chamber 21*c*, and a portion of the suction port 21*d* are formed by a first housing 21*e* surrounding the first impeller 21*a*.

The first impeller 21*a* is fixed to a rotation shaft 23, and is rotationally driven as the rotation shaft 23 has rotative power transmitted thereto from the output shaft 11 of the motor 12 and is rotated.

Figure 5:
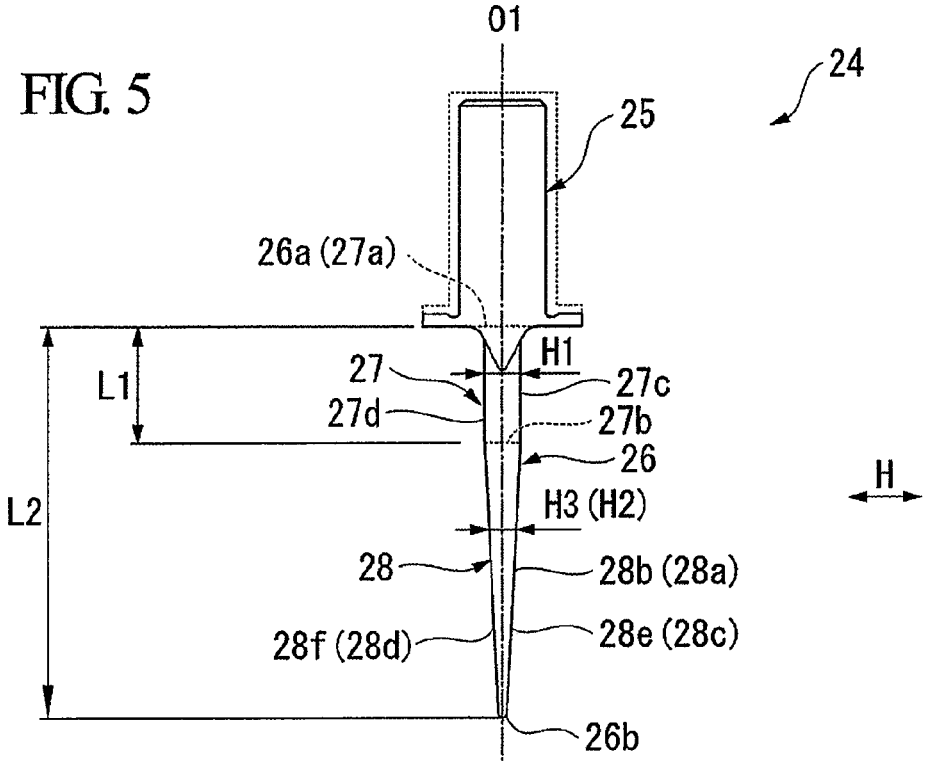
FIG. 5 is a front view of an inlet guide vane according to one embodiment of the present invention.

A plurality of inlet guide vanes 24 are installed at mutually regular intervals in a peripheral direction at an inner wall of the suction port 21*d* into which the refrigerant gas X4 is sucked by the rotation of the first impeller 21*a* of the first compression stage 21. Each inlet guide vane 24, as shown in FIGS. 5 and 6, is comprised of a round-bar-like shaft 25 and a plate-like vane body 26 connected to the tip of the shaft 25 in a state where mutual axes O1 are arranged on the same axis.

Figure 6:
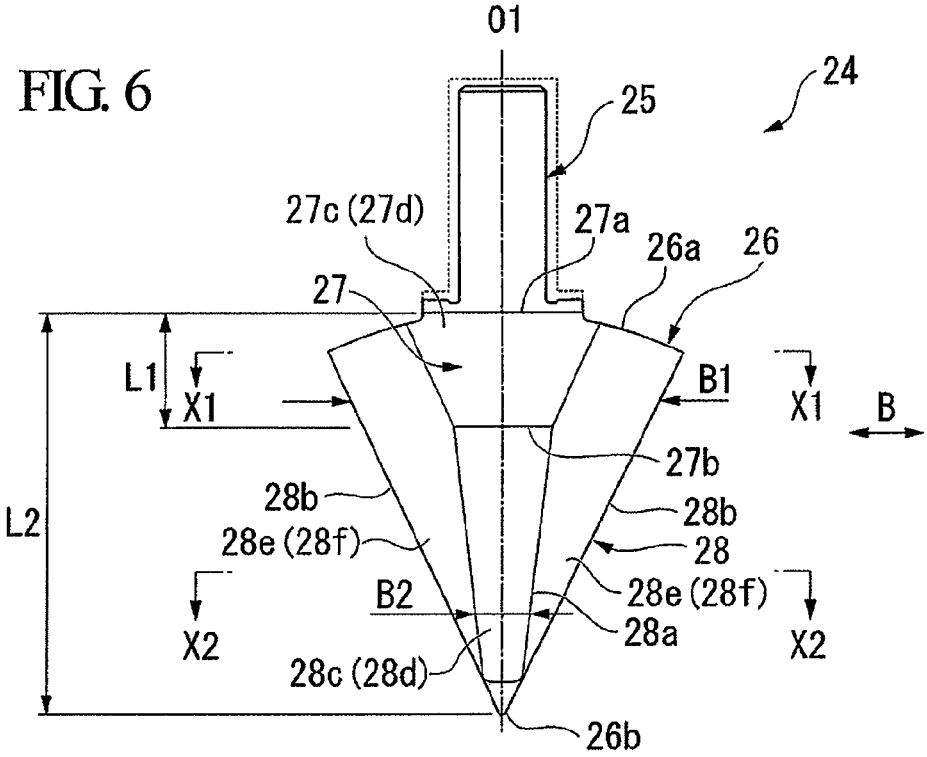
FIG. 6 is a side view of the inlet guide vane related to one embodiment of the present invention.
Figure 7:
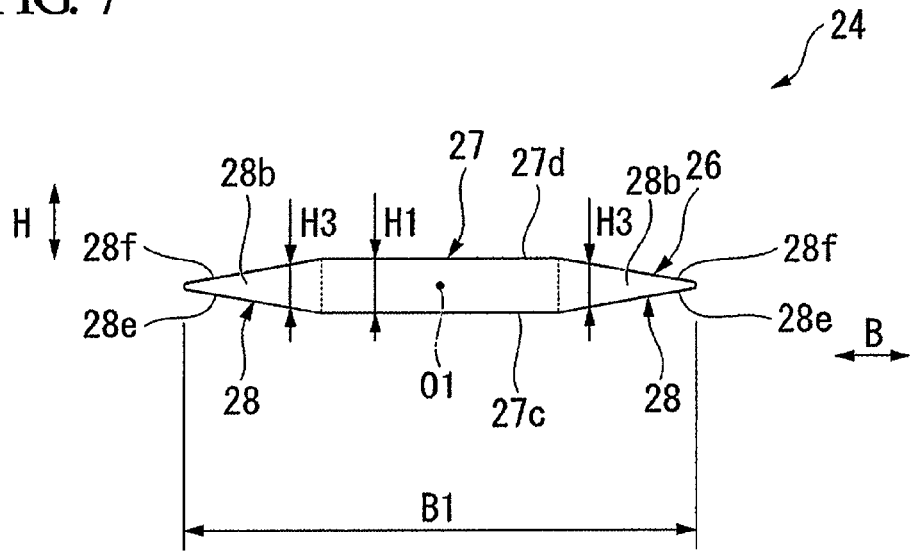
FIG. 7 is a sectional view as seen in the direction of an arrow at a line X1-X1 of FIG. 6.
Figure 8:
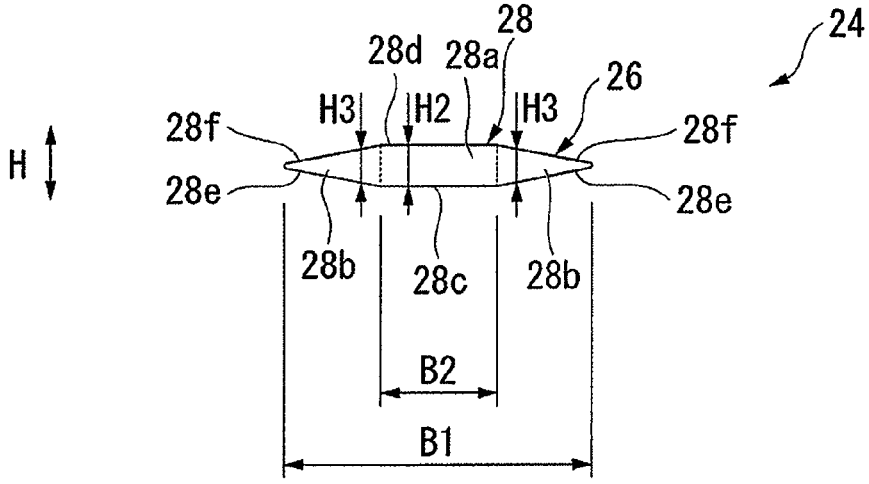
FIG. 8 is a sectional view as seen in the direction of an arrow at a line X2-X2 of FIG. 6.

The vane body 26, as shown in FIG. 6, is formed substantially in the shape of a fan in side view. That is, a rear end 26*a* of the vane body 26 connected to the shaft 25 is formed in the shape of a circular arc which has the same curvature as an inner peripheral surface 21*g* (refer to FIGS. 2 to 4) of the suction port 21*d*. Additionally, a width B1 of the vane body 26 is formed so as to become gradually smaller toward a tip 26*b* from the rear end 26*a* in the rotation of the axis O1. Additionally, the vane body 26, as shown in FIGS. 5 to 8, is comprised of a parallel portion 27 which is formed in the middle (on the axis O1) on the side of the rear end 26*a* and connected to the shaft 25, and a tapered portion 28 which is connected to the parallel portion 27, extends outward in a width direction B, and extends the tip 26*b* in the direction of the axis O1.

The parallel portion 27 is formed such that a thickness H1 is constant from a rear end 27*a* in the direction of the axis O1 connected to the shaft 25 to a tip 27*b*. Additionally, the parallel portion 27 is formed such that its length L1 in the direction of the axis O1 becomes equal to or more than ¼ and equal to or less than ½ of a length L2 of the vane body 26.

Meanwhile, the tapered portion 28 is comprised of a first tapered portion 28*a* and second tapered portions 28*b*. The first tapered portion 28*a* is disposed on an axis O1 is connected at the tip 27*b* of the parallel portion 27 at its rear end, and extends along the direction of the axis O1 to the vicinity of the tip 26*b* of the vane body 26. Additionally, the first tapered portion 28*a* is formed such that its width B2 and thickness H2 become gradually smaller toward its tip (outer edge at the tip in the direction of the axis O1) in the direction of the axis O1 from its rear end. The second tapered portions 28*b* are formed adjacent to the parallel portion 27 and the first tapered portion 28*a*, on both sides of the parallel portion 27 and the first tapered portion 28*a* in the width direction B, and extend from the rear end 26*a* of the vane body 26 to the tip 26*b* thereof. Additionally, the second tapered portions 28*b* are formed such that its thickness H3 becomes gradually smaller toward the outside (outer edge in the width direction B) in the width direction B and toward its tip (outer edge at the tip in the direction of the axis O1) from its rear end.

That is, in the vane body 26 of the inlet guide vane 24 of this embodiment, both side surfaces 27*c* and 27*d* of the parallel portion 27 are formed by planar surfaces which are parallel to each other in the direction of the axis O1, both side surfaces 28*c* and 28*d* of the first tapered portion 28*a* are formed by planar surfaces which approach each other toward the tip 26*b* in the direction of the axis O1 (inclines inward in a thickness direction H), and both side surfaces 28*e* and 28*f* of the second tapered portions 28*b* are formed by planar surfaces which approach each other toward the tip 26*b* in the direction of the axis O1 (inclines inward in the thickness direction H) and approach each other in the width direction B outside (inclines inward in the width direction B). Hence, both the side surfaces of the vane body 26 (inlet guide vane 24) are not provided with curved surfaces, but are formed by combining planar surfaces. In addition, one side surfaces 27*c*, 28*c*, and 28*e* of the parallel portion 27, the first tapered portion 28*a*, and the second tapered portions 28*b* are side surfaces on the side which becomes positive pressure at the time of adjustment of the suction volume and flow direction of the refrigerant gas X4, and the side surfaces 27*d*, 28*d*, and 28*f* are side surfaces on the side which becomes negative pressure.

The inlet guide vane 24 of this embodiment is molded as a cast product by casting in the same manner as a conventional one. At this time, since both the side surfaces of the vane body 26 are formed by combining planar surfaces, the vane body 26 is easily molded with precision as compared with a conventional case (a case where both the side surfaces are formed by curved surfaces) where both the side surfaces are formed in a the shape of an aerofoil.

The precision of the shaft 25 is secured by molding a shaft with a large dimension in advance as indicated by a broken line of FIGS. 5 and 6, and shaving the shaft after casting. The shaft 25 is machined with the vane body 26 held. In this regard, in this embodiment, the side surfaces 27*c* and 27*d* which are parallel to each other in the direction of the axis O1 are formed in the vane body 26 by the parallel portion 27. Therefore, by holding (gripping) the parallel portion 27, that is, by utilizing both the side surfaces 27*c* and 27*d* of the parallel portion 27 as holding tabs, reference setting can be performed by easily aligning the direction of the axis O1 with a desired direction as compared with the conventional case the both the side surfaces are formed in the shape of an aerofoil is molded in the shape of an aerofoil (the case where both the side surfaces are formed by curved surfaces). Particularly, the reference setting can be performed by setting the length L1 of the parallel portion 27 to be equal to or more than ¼ of the length L2 of the vane body 26 or using both the side surfaces 27*c* and 27*d* of the parallel portion 27 as holding tabs. Hence, the shaft 25 can be machined easily, the inlet guide vane 24 can be manufactured with high precision, and the manufacturing cost can be reduced.

As shown in FIGS. 2 to 4, the inlet guide vane 24 configured in this way is installed in a state where the shaft 25 is attached to and supported by the driving mechanism 21*h* fixed to the first housing 21*e*, and the vane body 26 is made to protrude inward from the inner peripheral surface 21*g* of the suction port 21*d*. A plurality of inlet guide vanes 24 are arranged in parallel at equal intervals in the peripheral direction of the suction port 21*d*. Since the inlet guide vanes 24 are formed with high precision, the inlet guide vanes are installed with precision in a state where the direction of the axis O1 coincides with the radial direction of the suction port 21*d*. Each inlet guide vane 24 is installed so as to be rotatable within a range of 90 degrees around the axis O1 by the driving of the driving mechanism 21*h* to a position along the flow direction from a state where one side surface (side surface on the side of the positive pressure) of the vane body 26 is made to face the rear side in the flow direction of the refrigerant gas X4.

The second compression stage 22 includes a second impeller 22*a* which gives velocity energy to the refrigerant gas X4 compressed in the first compression stage 21 and supplied from the thrust direction, thereby discharging the refrigerant gas in the radial direction, a second diffuser 22*b* which converts the velocity energy given to the refrigerant gas X4 by the second impeller 22*a* into pressure energy, thereby compressing the refrigerant gas to discharge the refrigerant as the compressed refrigerant gas X1, a second scroll chamber 22*c* which guides the compressed refrigerant gas X1 discharged from the second diffuser 22*b* to the outside of the second compression stage 22, and an introducing scroll chamber 22*d* which introduces the refrigerant gas X4 compressed in the first compression stage 21 to the second impeller 22*a*.

The second impeller 22*a* is fixed to the rotation shaft 23 so as to face the first impeller 21*a* back to back and is rotationally driven as the rotation shaft 23 has rotative power transmitted thereto from the output shaft 11 of the motor 12 and is rotated.

The second scroll chamber 22*c* is connected to the flow path R1 for supplying the compressed refrigerant gas X1 to the condenser 1, and supplies the compressed refrigerant gas X1 drawn from the second compression stage 22 to the flow path R1.

The first scroll chamber 21*c* of the first compression stage 21 and the introducing scroll chamber 22*d* of the second compression stage 22 are connected together via an external pipe (not shown) which is provided separately from the first compression stage 21 and the second compression stage 22, and the refrigerant gas X4 compressed in the first compression stage 21 is supplied to the second compression stage 22 via the external pipe. The aforementioned flow path R4 (refer to FIG. 1) is connected to this external pipe, and the gaseous refrigerant X3 generated in the economizer 2 is supplied to the second compression stage 22 via the external pipe.

The rotation shaft 23 is rotatably supported by a third bearing 29*a* fixed to the second housing 22*e* of the second compression stage 22, and a fourth bearing 29*b* fixed to the second housing 22*e* on the side of the motor unit 10, in a space 50 between the first compression stage 21 and the second compression stage 22.

The gear unit 30 is for transmitting the rotative power of the output shaft 11 of the motor 12 to the rotation shaft 23, and is housed in a space 60 formed by the motor housing 13 of the motor unit 10, and the second housing 22*e* of the compressor unit 20.

The gear unit 30 is comprised of a large-diameter gear 31 fixed to the output shaft 11 of the motor 12, and a small-diameter gear 32 which is fixed to the rotation shaft 23, and meshes with the large-diameter gear 31, and the rotative power of the output shaft 11 of the motor 12 is transmitted to the rotation shaft 23 so that the rotation number of the rotation shaft 23 may increase with an increase in the rotation number of the output shaft 11.

The turbo compressor 4 includes a lubricant-supplying device 70 which supplies lubricant stored in the oil tank 40 to bearings (the first bearing 14, the second bearing 15, the third bearing 29*a*, and the fourth bearing 29*b*), to between an impeller (the first impeller 21*a*, or the second impeller 22*a*) and a housing (the first housing 21*e* or the second housing 22*e*), and to sliding parts, such as the gear unit 30.

Subsequently, the operation of the turbo compressor 4 configured in this way will be described, and the operation and effects of the inlet guide vanes 24, the turbo compressor 4, and the turbo refrigerator S1 of this embodiment will be described.

First, lubricant is supplied to respective sliding parts of the turbo compressor 4 from the oil tank 40 by the lubricant-supplying device 70, and then, the motor 12 is driven. The rotative power of the output shaft 11 of the motor 12 is transmitted to the rotation shaft 23 via the gear unit 30, and thereby, the first impeller 21*a* and the second impeller 22*a* of the compressor unit 20 are rotationally driven.

When the first impeller 21*a* is rotated, the suction port 21*d* of the first compression stage 21 is in a negative pressure state, and the refrigerant gas X4 from the flow path R5 flows into the first compression stage 21 via the suction port 21*d*. At this time, the suction volume and flow direction of the refrigerant gas X4 to the first compression stage 21 are adjusted by driving the driving mechanism 21*h* and rotating each inlet guide vane 24 installed in the suction port 21*d*, thereby rotating the side surface of the vane body 26 on the side of the positive pressure by a proper angle of attack (rotating angle) with respect to the flow direction of the refrigerant gas X4.

In this embodiment, the vane body 26 includes the tapered portion 28 (the first tapered portion 28*a* and the second tapered portion 28*b*), and is formed such that the thickness H3 becomes smaller toward the outside in the width direction B and the thickness H2 and H3 becomes smaller toward the tip 26*b* in the direction of the axis O1. For this reason, a pressure loss caused by the adjustment of the suction volume and flow direction of the vane body 26 (inlet guide vane 24) with respect to the rotational driving of the first impeller 21*a* becomes smaller similarly to the conventional case where the side surface on the side of the positive pressure and the side surface on the side of the negative pressure are formed in the shape of an aerofoil as curved surfaces.

Particularly, since the flow velocity of the refrigerant gas X4 becomes the largest at a central portion of the suction port 21*d*, and the pressure loss is proportional to the square of this flow velocity, the shape on the side of the tip 26*b* of the vane body 26 has a great effect on the pressure loss. However, since the vane body 25 includes the tapered portion 28 and is formed such that the thicknesses H2 and H3 becomes smaller gradually toward the tip 26*b* in the direction of the axis O1, i.e., toward the central portion of the suction port 21*d*), the pressure loss becomes reliably smaller.

The refrigerant gas X4 of which the suction volume and flow direction are adjusted by the inlet guide vane 24 and which has flowed into the inside of the first compression stage 21 reliably flows into the first impeller 21*a* from the thrust direction, and the refrigerant gas has velocity energy given thereto by the first impeller 21*a*, and is discharged in the radial direction. Since the pressure loss when the suction volume and flow direction are adjusted by an inlet guide vane 24 is small, the consumption power of the first impeller 21*a* and the consumption power of the turbo compressor 4 decreases reliably and effectively by the refrigerant gas X4 which has flowed in from the thrust direction.

The refrigerant gas X4 discharged from the first diffuser 21*b* is guided to the outside of the first compression stage 21 via the first scroll chamber 21*c*, and is supplied to the second compression stage 22 via the external pipe. The refrigerant gas X4 supplied to the second compression stage 22 flows into the second impeller 22*a* from the thrust direction via the introducing scroll chamber 22*d*, and the refrigerant gas has velocity energy given thereto by the second impeller 22*a*, and is discharged in the radial direction. The refrigerant gas X4 discharged from the second impeller 22*a* is further compressed into the compressed refrigerant gas X1 as velocity energy is converted into pressure energy by the second diffuser 22*b*.

Accordingly, in the inlet guide vane 24 of this embodiment, because the vane body 26 is provided with the tapered portion 28, similarly to the inlet guide vane in which the vane body is formed in the shape of an aerofoil, the suction volume and flow direction can be adjusted without disturbing the flow of the refrigerant gas X4, and the pressure loss can be made reliably smaller.

Additionally, since both the side surfaces of the vane body 26 are formed by combining planar surfaces, the vane body 26 is easily produced with precision as compared with a conventional case (a case where both the side surfaces are formed by curved surfaces) where both the side surfaces are formed in the shape of an aerofoil. Moreover, since both the parallel portions 27 in which the side surfaces 27*c* and 27*d* are parallel to each other in the direction of the axis O1 are provided on the axis O1, reference setting can be easily performed by holding the parallel portion 27 at the time of machining of the shaft 25 after casting. Hence, the manufacturing cost of the inlet guide vanes 24 can be reduced.

Additionally, since the parallel portion 27 is provided on the rear end 26*a* in the direction of the axis O1 connected to the shaft 25, the tapered portion 28 can be largely provided at the tip 26*b* arranged at the central portion of the suction port 21*d* with a large flow velocity, and the thicknesses H2 and H3 at the side of the tip 26*a* of the vane body 26 can be made reliably smaller. Hence, the pressure loss can be made reliably smaller.

Moreover, since the parallel portion 27 is formed with the length L1 that is equal to or more than ¼ of the length L2 of the vane body 26, the reference setting can be performed by reliably holding the parallel portion 27 at the time of machining of the shaft 25. Additionally, the parallel portion 27 is formed with the length L1 that is equal to or less than ½ of the length L2 of the vane body 26. Hence, with the tapered portion 28 provided at the tip 26*b* arranged at the central portion of the suction port 21*d* with a large flow velocity, the suction volume and flow direction can be adjusted without disturbing the flow of the refrigerant gas X4, and the pressure loss can be made reliably smaller.

By providing such inlet guide vanes 24, the consumption power of the turbo compressor 4 and the turbo refrigerator S1 of this embodiment can be reduced, and the performance thereof can be improved. Additionally, in the turbo refrigerator S1, the COP (coefficient of performance) can be raised.

The present invention is not limited to the above embodiments, and additions, omissions, substitutions, and other modifications can be made without departing from the spirit or scope of the present invention. Accordingly, the present invention is not to be considered as being limited by the foregoing description, and is only limited by the scope of the appended claims.

For example, although this embodiment has been described such that the parallel portion 27 of the vane body 26 of each inlet guide vane 24 is provided at the rear end 26*a*, in the direction of the axis O1, of the vane body 26 which is connected to the shaft 25, the parallel portion 27 is not particularly limited to being provided at the rear end 26*a* connected to the shaft 25.

The above embodiment has been described such that the tapered portion 28 is comprised of the first tapered portion 28*a* and the second tapered portions 28*b*, the first tapered portion 28*a* is formed such that its width B2 and thickness H2 becomes gradually smaller toward its tip in the direction of the axis O1 from its rear end, and the second tapered portion 28*b* is formed such that its thickness H3 becomes gradually smaller toward the outside (outer edge in the width direction B) in the width direction B and toward its tip (outer edge at the tip in the direction of the axis O1) from its rear end. However, in the present invention, both the side surfaces of the tapered portion 28 need only to approach each other toward the outer edge in the width direction B and the outer edge at the tip 26*b* in the direction of the axis O1, and the thickness H2 or H3 of the first tapered portion 28*a* or the second tapered portion 28*b* do not need to be changed at a constant ratio.

Additionally, although the embodiment has been described such that the inlet guide vanes 24 are installed in the suction port 21*d* of the turbo compressor 4, the inlet guide vanes according to the present invention are not limited to being used for the turbo compressor.

What is claimed is:

1. An inlet guide vane configured for a suction port into which a fluid is sucked by rotation of an impeller, the inlet guide vane positioned so as to be rotatable about an axis, and configured to adjust a suction volume and flow direction of the fluid to the suction port, the inlet guide vane comprising:

a rod-like shaft positioned and configured to be supported by an inner peripheral surface of the suction port so as to be rotatable about the axis, and a plate-like vane body that is connected to the shaft and positioned so as to protrude from the inner peripheral surface of the suction port toward a central portion thereof, wherein the vane body has a first side surface on a side which becomes positive pressure and a second side surface on the side which becomes negative pressure, at the time of adjustment of the suction volume and flow direction of the fluid, the vane body includes:

a tapered portion formed such that the first and second side surfaces approach each other toward an outer edge of the vane body in its width direction and an outer edge thereof at a tip in the direction of the axis, and a parallel portion arranged on the axis and formed such that the first side surface on the side which becomes positive pressure and the side surface on the side which becomes negative pressure is parallel to the second side surface along the direction of the axis, and a length of the parallel portion in the direction of the axis is ¼ to ½ of the length of the vane body in the direction of the axis.

2. The inlet guide vane according to claim 1, wherein the parallel portion is provided at a rear end, in the direction of the axis, of the vane body that is connected to the shaft.

3. A turbo compressor for sucking in a fluid from a suction port, the turbo compressor configured to compress the fluid and to supply the fluid to a condenser, the turbo compressor comprising:

a plurality of compression devices arranged in series with the flow of the fluid sucked from the suction port, wherein each compression device includes an impeller and a diffuser, and the fluid is compressed sequentially in the plurality of compression devices, wherein the inlet guide vane according to claim 2 is installed at the suction port.

4. A turbo compressor for sucking in a fluid from a suction port, the turbo compressor configured to compress the fluid and to supply the fluid to a condenser, the turbo compressor comprising:

a plurality of compression devices arranged in series with the flow of the fluid sucked from the suction port, wherein each compression device includes an impeller and a diffuser, and the fluid is compressed sequentially in the plurality of compression devices, wherein the inlet guide vane according to claim 1 is installed at the suction port.

5. A refrigerator comprising:

a condenser configured to cool and to liquify a compressed refrigerant;

an evaporator configured to evaporate the liquefied refrigerant and to deprive vaporization heat from an object to be cooled, thereby cooling the object to be cooled; and a compressor configured to compress the refrigerant evaporated in the evaporator and to supply the refrigerant to the condenser, wherein the compressor comprises the turbo compressor according to claim 4.

6. A turbo compressor for sucking in a fluid from a suction port, compressing the fluid, and supplying the fluid to a condenser, comprising:

a plurality of compression devices arranged in series with the flow of the fluid sucked from the suction port, wherein the inlet guide vane according to claim 1 is installed at the suction port.

* * * * *